US012497971B2

(12) United States Patent
Alexander et al.

(10) Patent No.: US 12,497,971 B2
(45) Date of Patent: Dec. 16, 2025

(54) SYSTEM FOR ADAPTING FOOT SPAS FOR USE WITH DISPOSABLE PUMPS

(71) Applicant: Gulfstream Inc., Cambridge (CA)

(72) Inventors: Chris Alexander, Cambridge (CA); Minh Sang Tran, Cambridge (CA)

(73) Assignee: Gulfstream Inc., Cambridge (CA)

( * ) Notice: Subject to any disclaimer, the term of this patent is extended or adjusted under 35 U.S.C. 154(b) by 523 days.

(21) Appl. No.: 17/851,343

(22) Filed: Jun. 28, 2022

(65) Prior Publication Data

US 2022/0412365 A1 Dec. 29, 2022

Related U.S. Application Data

(60) Provisional application No. 63/216,508, filed on Jun. 29, 2021.

(51) Int. Cl.

| | |
|---|---|
| ***F04D 25/02*** | (2006.01) |
| ***A47K 3/00*** | (2006.01) |
| ***A47K 3/022*** | (2006.01) |
| ***F04D 29/40*** | (2006.01) |

(52) U.S. Cl.

CPC ..... *F04D 25/026* (2013.01); *A47K 3/001* (2013.01); *A47K 3/022* (2013.01); *F04D 29/406* (2013.01)

(58) Field of Classification Search

CPC ..... A61H 33/005; A61H 33/0087; A61H 2205/12; A47K 3/001; A47K 3/022; F04D 25/026; F04D 29/406; H02K 49/108; H02K 1/24

USPC ..... 4/541.1, 574.1, 662; 417/423.7

See application file for complete search history.

(56) References Cited

U.S. PATENT DOCUMENTS

| | | | | |
|---|---|---|---|---|
| 2,542,896 | A * | 2/1951 | Brady, Jr. | A47J 45/02 415/228 |
| 3,802,804 | A * | 4/1974 | Zimmermann | F04D 13/026 417/420 |
| 4,982,461 | A * | 1/1991 | Mikiya | A61H 33/6047 4/541.3 |
| 8,214,937 | B2 * | 7/2012 | Lawyer | A61H 33/6063 4/541.1 |
| 8,944,786 | B1 * | 2/2015 | McDougall | H01L 23/043 4/541.3 |
| 9,205,023 | B2 * | 12/2015 | Tran | A61H 33/6063 |
| 10,219,977 | B2 * | 3/2019 | Tran | H02K 49/108 |
| 2010/0239435 | A1 * | 9/2010 | Le | F04F 5/10 417/54 |

(Continued)

*Primary Examiner* — David P Angwin
*Assistant Examiner* — William R Klotz
(74) *Attorney, Agent, or Firm* — MaxGoLaw PLLC

(57) ABSTRACT

A system for use with a spa adapted for use with a pump having a drive hub. The system comprises an adapter and a disposable pump. The adapter: has a housing defining a recess, a rotor in the recess and an operative position; and is adapted, when operatively positioned: for rotation of the rotor upon rotation of the drive hub. The disposable pump has: a housing having a pair of sides and a void, one of the sides defining an intake and a port, the intake communicating with a center of the void and the port communicating with a void periphery; an impeller in the void; and an operative position adjacent the adapter. The disposable pump is adapted, when operatively positioned, for rotation upon rotation of the drive hub and consequent rotation of the rotor, to draw water through the intake and eject water through the one or more ports.

14 Claims, 18 Drawing Sheets

(56) References Cited

U.S. PATENT DOCUMENTS

| | | | | |
|---|---|---|---|---|
| 2011/0253236 | A1* | 10/2011 | Le | F04F 5/10<br>417/151 |
| 2014/0020684 | A1* | 1/2014 | Klasek | A61M 16/16<br>128/203.26 |
| 2014/0234143 | A1* | 8/2014 | Marks | F04D 29/628<br>417/420 |
| 2015/0352004 | A1* | 12/2015 | Konstantakis | A61H 33/6063<br>4/507 |
| 2017/0159661 | A1* | 6/2017 | Gieras | F04D 29/24 |

* cited by examiner

SYSTEM FOR ADAPTING FOOT SPAS FOR USE WITH DISPOSABLE PUMPS

FIELD

The invention relates to the field of foot spas.

BACKGROUND

A pump for a foot spa is shown in U.S. Ser. No. 17/021,004. This pump is advantageous in that it is relatively inexpensive to produce and as such is well suited for disposable use. However, it would be advantageous for this pump to be rendered useful with prior art pedicure stations that have drive hubs and cover plates that differ from those shown in U.S. Ser. No. 17/021,004.

SUMMARY OF THE INVENTION

Forming one aspect of the invention is a system for use with a spa.

The spa is of the type comprising a basin, a motor and a drive hub and adapted for use with a pump.

The basin is for containing water.

The motor is mounted exteriorly of the basin and has a rotating element defining an axis.

The drive hub is coupled to the rotating element for movement therewith and has magnetic properties such that, in the absence of externalities, a magnetic field is produced which extends from and returns to the hub, the magnetic field being characterized in that, if depicted graphically, concentrations of field lines would appear to extend from one or more North pole domains defined in the surface to one or more South pole domains defined in the surface, the North and South pole domains being spaced apart from each other and arranged to encircle the rotation axis in alternating relation.

The pump includes a housing and an impeller.

The housing has a pair of sides and defines a cavity, one of the pair of sides defining an intake communicating with the cavity and one or more ports communicating with the cavity.

The impeller is disposed in the cavity, has an operative position in use whereat the pump is disposed in the basin with the other of the sides presenting towards the drive hub; and is adapted, when operatively positioned, for releasable engagement with the basin and further adapted such that, upon rotation of the drive hub and rotation of the impeller in the cavity, to draw water through the intake and eject water through the one or more ports The system comprises an adapter and a disposable pump.

The adapter has: a housing defining a recess; a rotor positioned in the recess; an operative position in use whereat the adapter is disposed in the basin adjacent towards the drive hub; and is adapted, when operatively positioned: for releasable engagement with the basin; and for rotation of the rotor upon rotation of the drive hub; and The disposable pump has: a housing having a pair of sides and defining a void having a center and a periphery, one of the pair of sides defining an intake and one or more ports, the intake communicating with the center of the void and the ports communicating with the periphery; an impeller in the void; and an operative position in use whereat the pump is disposed in the basin adjacent the adapter with the other of the sides presenting towards the adapter; and is adapted, when operatively positioned, for rotation in the void upon rotation of the drive hub and consequent rotation of the rotor, to draw water through the intake and eject water through the one or more ports.

According to another aspect, the impeller can be adapted to draw water through the intake and eject water through the one or more ports as aforesaid by broad flat blades and wherein the impeller can include a portion that is ferromagnetic and a portion that is not ferromagnetic, the portions being axially displaced from the other.

According to another aspect, the portions can abut one another at a junction that is generally circular.

According to another aspect, the ferromagnetic portion can define the blades.

According to another aspect, the ferromagnetic portion can be steel.

According to another aspect, the ferromagnetic portion can be a steel stamping.

According to another aspect, the portion that is not ferromagnetic can be aluminum.

According to another aspect, the ferromagnetic portion can have a thickness X10, the portion that is not ferromagnetic can have a thickness X11, X10 can be between about 0.1 mm and 0.2 mm and X11 can be between about 0.9 mm and 2.0 mm.

According to another aspect, X10 can be about 0.15 mm and X11 can be about 2 mm.

According to another aspect, the rotor can have a rotation axis and can comprises:

a pair of magnetic layers disposed in parallel relation to one another and such that the rotation axis passes centrally through each magnetic layer and in perpendicular relation thereto; and a ferromagnetic layer between the magnetic layers.

According to another aspect, each of the magnetic layers can have a plurality of magnetic portions ringing the rotation axis.

According to another aspect, the one of the pair of magnetic layers which, in use, is disposed adjacent the pump, can have more magnetic portions than the other of the pair of magnetic layers.

According to another aspect, the one of the pair of magnetic layers can have a thickness X1; the other of the pair of magnetic layers can have a thickness X2;

the ferromagnetic layer can have a thickness X3; the housing can have a pair of walls orientated perpendicular to the rotation axis, the walls having respective thicknesses X4 and X5; and the rotor can be disposed in spaced relation to the housing such that the spaces between the magnetic layers and the housing are X6 and X7.

According to another aspect:

X1 can be about 3 mm;

X2 can be about 3 mm;

X3 can be about 1.6 mm;

X4 can be about 1 mm;

X5 can be about 1 mm;

X6 can be about 1 mm; and

X7 can be about 1 mm.

According to another aspect, the ferromagnetic layer can be iron and the walls can be plastic.

Advantages, features and characteristics of the invention will become apparent to persons of ordinary skill in the art upon a review of the following detailed description with reference to the appended drawings, the latter being briefly described hereinbelow.

DETAILED DESCRIPTION

Figure 1:
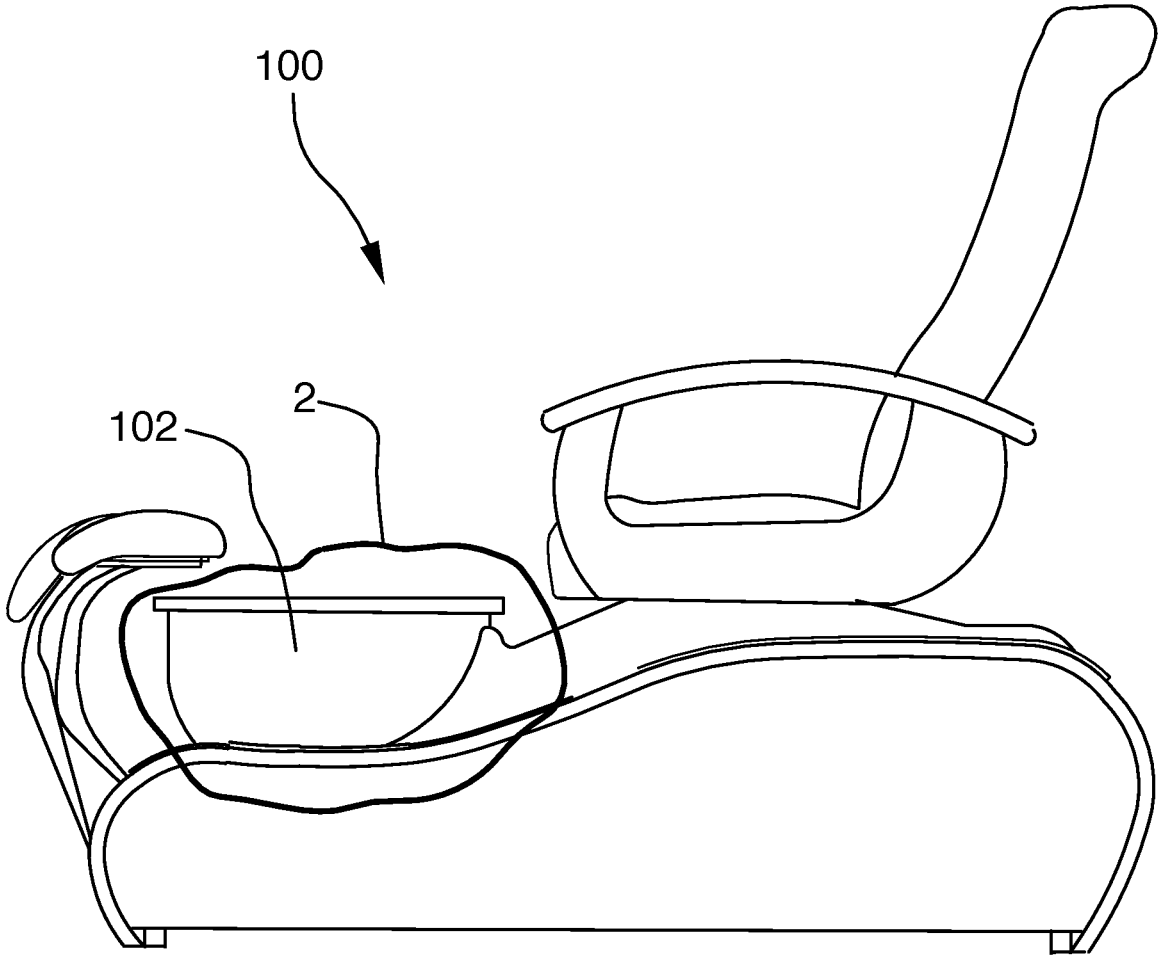
FIG.1 PRIOR ART
FIG. 1 is a side view of a prior art pedicure station

A prior art pedicure station 100 is shown in FIG. 1 through FIG. 5 and will be understood to include a basin 102, a motor 104, a drive hub 106 and a pump 108.

The basin 102 is for containing water and includes a cover plate 110 that occludes a hole (not shown) in a sidewall of the basin and has a plurality of sockets 112 defined therein.

The motor 104 is mounted exteriorly of the basin 102, behind the cover plate 112, and has a rotating element 114 defining an axis X-X.

The drive hub 106 is coupled to the rotating element 114 for movement therewith and has magnetic properties such that, in the absence of externalities, a magnetic field is produced which extends from and returns to the hub 106, through the cover plate 110, the magnetic field being characterized in that, if depicted graphically, concentrations of field lines would appear to extend from one or more North pole domains 116 defined in the surface to one or more South pole domains 118 defined in the surface, the North and South pole domains being spaced apart from each other and arranged to encircle the rotation axis in alternating relation.

The pump 108 includes a housing 120 and an impeller 122.

The housing 120 has a pair of sides 124, 126 and defines a cavity 128 having a center and a periphery. One 124 of the pair of sides defines an intake 130 and one or more ports 132, the intake communicating with the center of the cavity and the ports communicating with the periphery. The other 126 of the pair of sides has a plurality of feet 134.

The impeller 122 is disposed in the cavity 128.

Figure 2:
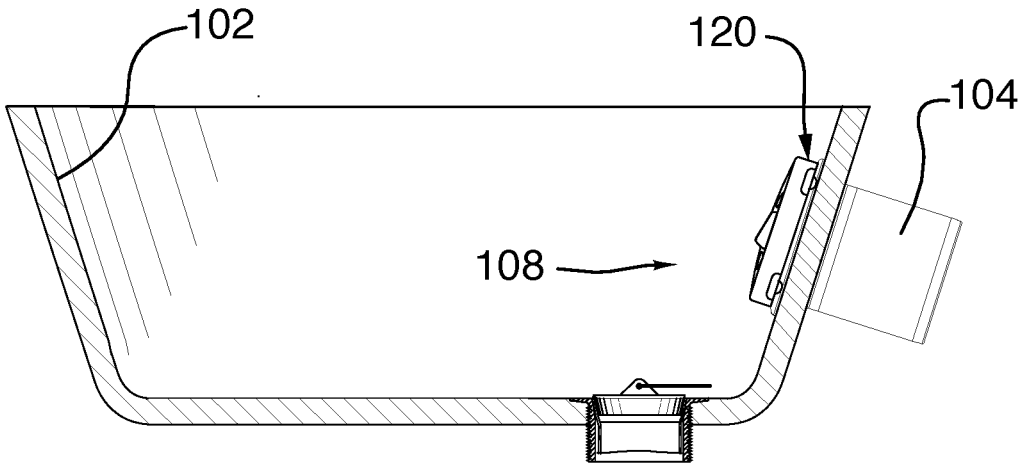
FIG.2 PRIOR ART
FIG. 2 is a cross-sectional view of the structure of encircled area 2 of FIG. 1.
Figure 3:
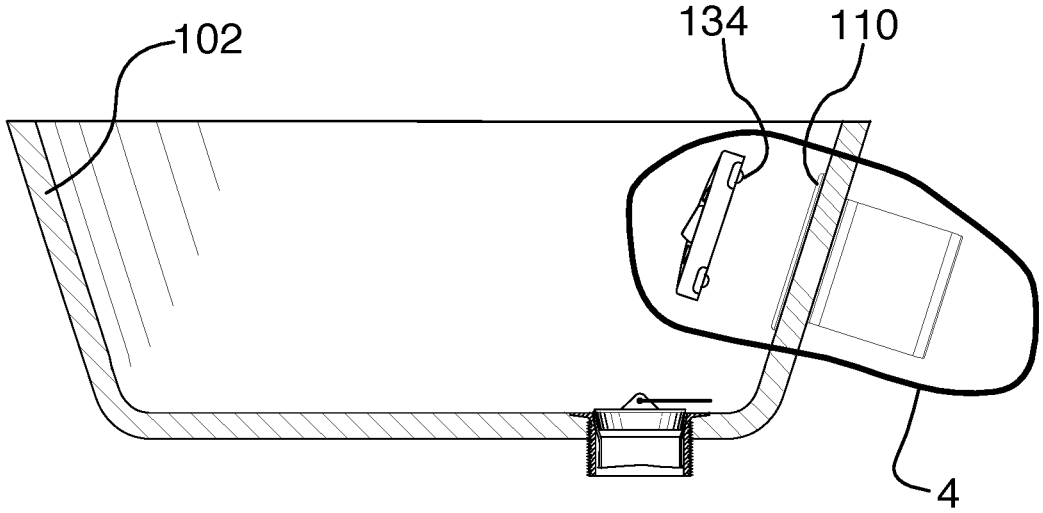
FIG.3 PRIOR ART
FIG. 3 is an exploded view of the structure of FIG. 2.
Figure 4:
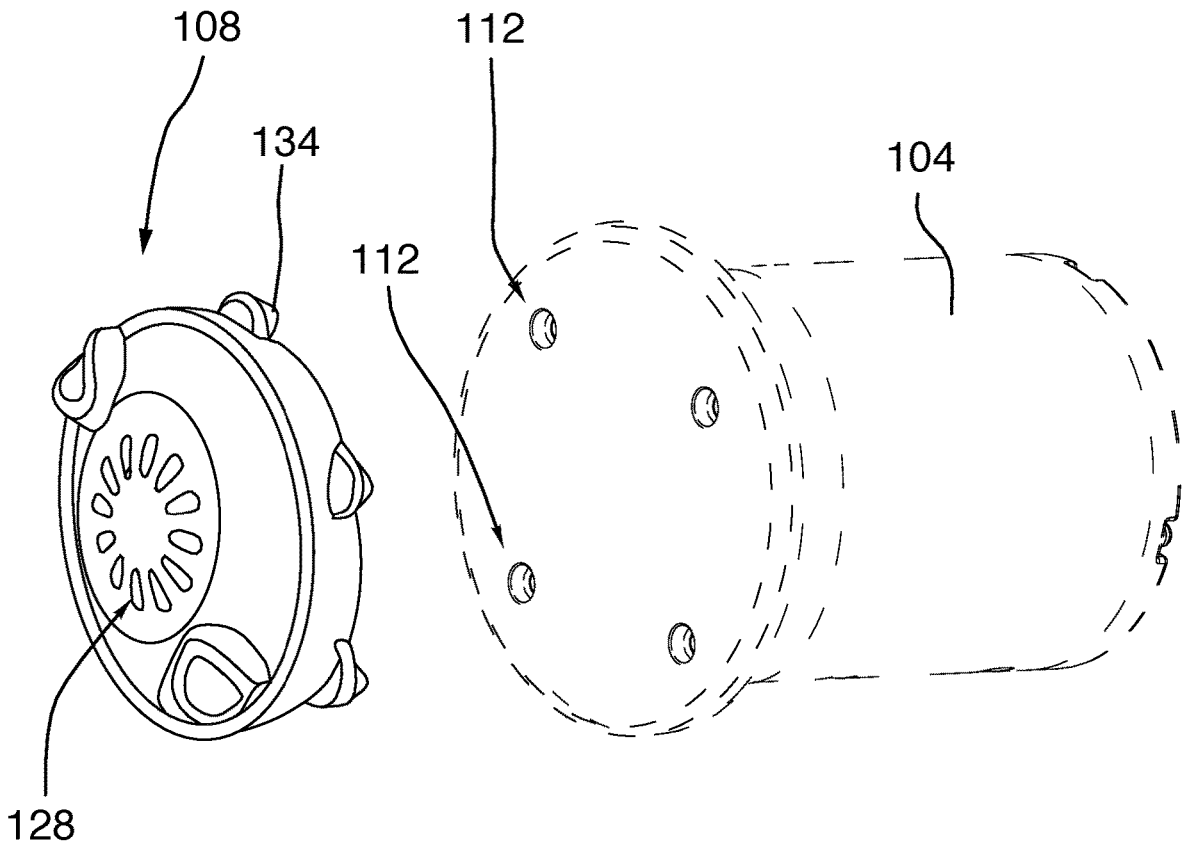
FIG.4 PRIOR ART
FIG. 4 is a perspective view of the structure of encircled area 4 of FIG. 3.
Figure 5:
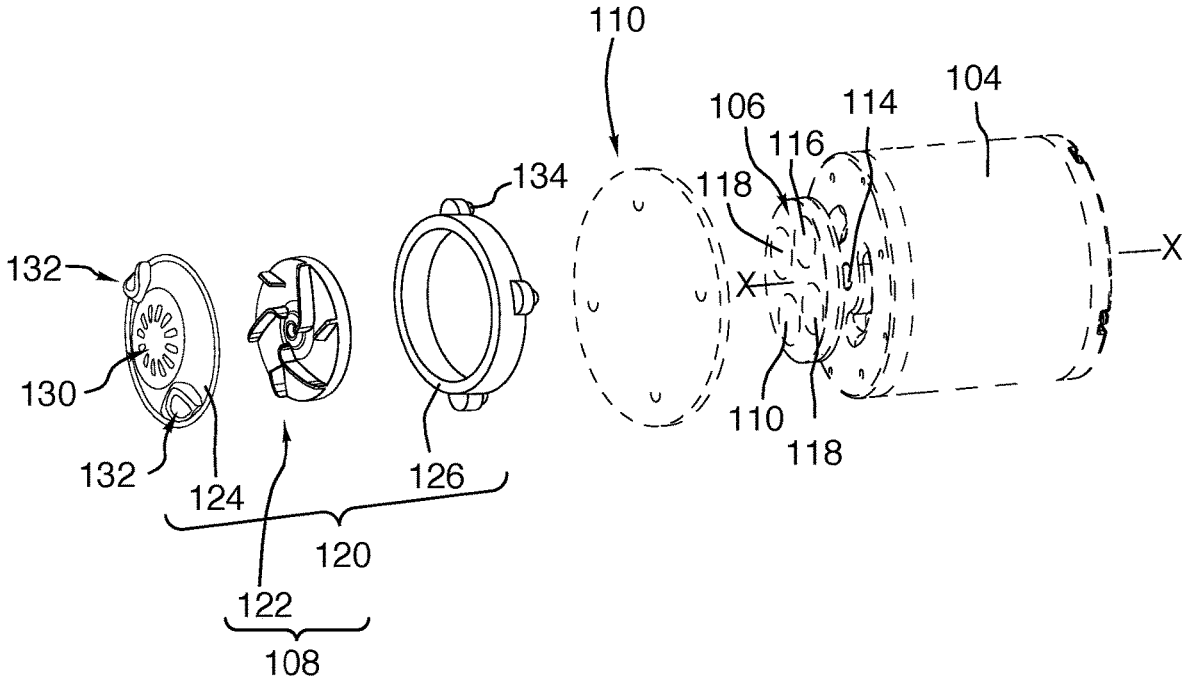
FIG.5 PRIOR ART
FIG. 5 is an exploded view of the structure of FIG. 4.

The housing 120 has an operative position in use, as shown in FIG. 2, whereat the pump 108 is disposed in the basin with the other of the sides presenting towards the drive hub 106 and the feet 134 engaged in the sockets 112 of cover plate 110.

The housing 120 is adapted, when so operatively positioned, for releasable engagement with the basin 102. Such releasable engagement is provided by attractive force between the magnets 116,118 in the drive hub 106 and the impeller 122 and by mechanical engagement of the feet 134 in the sockets 112.

The housing 120 is further adapted such that, when the basin is filled with water and the drive hub 106 is rotated, the impeller 122 rotates in the cavity 128 to draw water through the intake 130 and eject same through the one or more ports 132, to circulate water in the basin 102.

Figure 6:
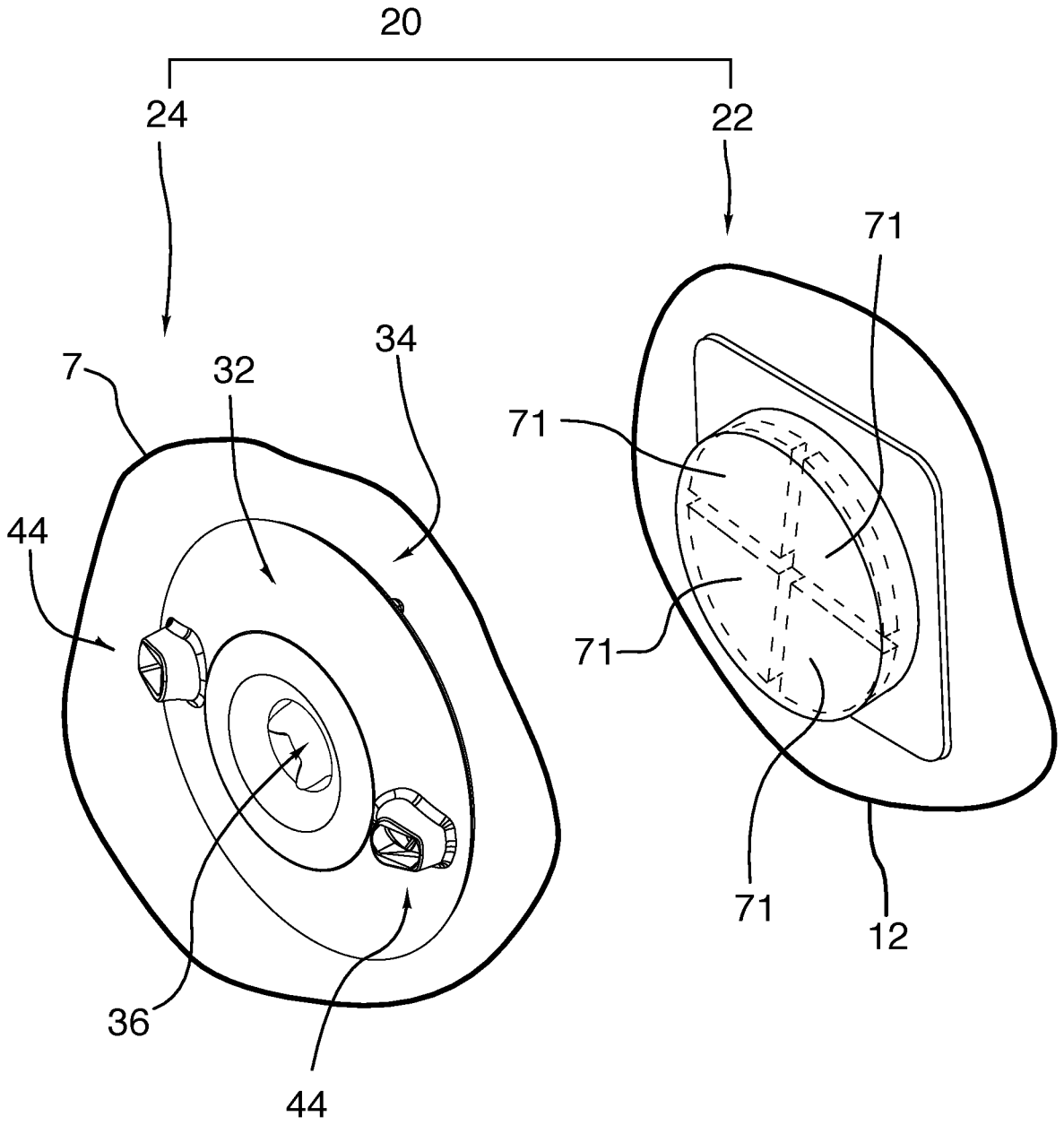
FIG. 6 is a view of a system according to an example embodiment of the invention.
Figure 7:
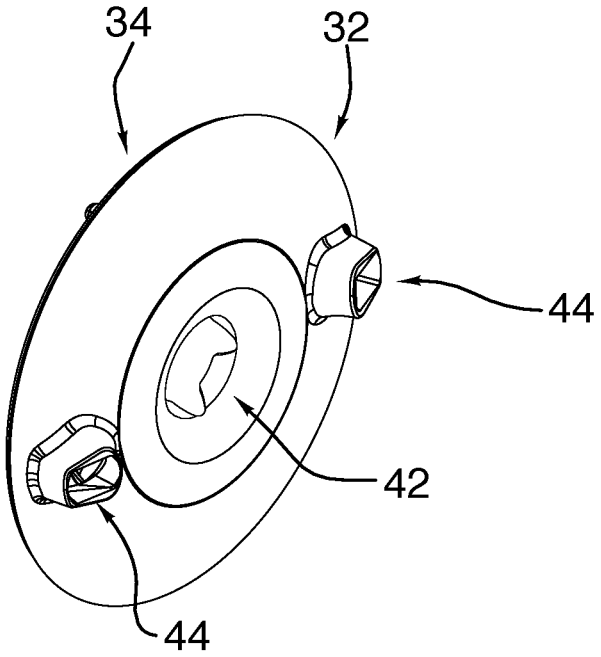
FIG. 7 is another view of the structure of encircled area 7 of FIG. 6.
Figure 8:
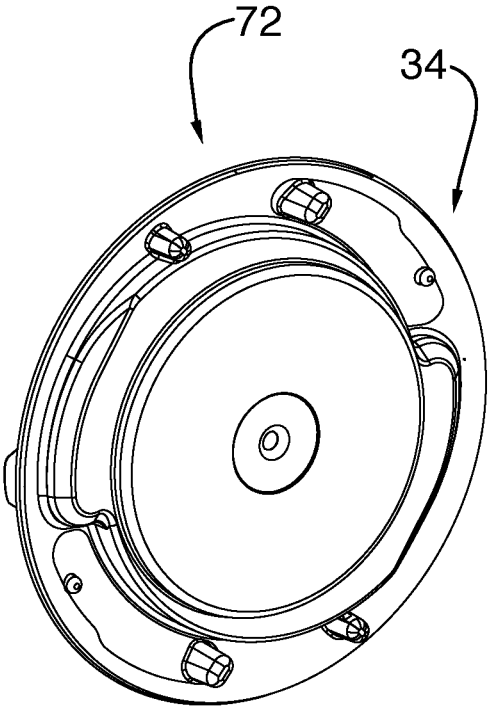
FIG. 8 is a rear view of the structure of FIG. 7.
Figure 9:
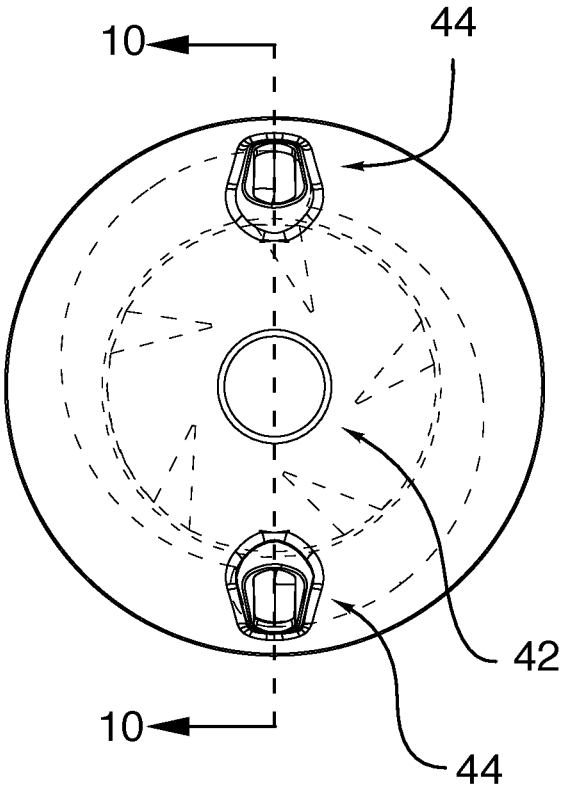
FIG. 9 is a plan view of the structure of FIG. 7, with internal components shown in phantom outline.
Figure 10:
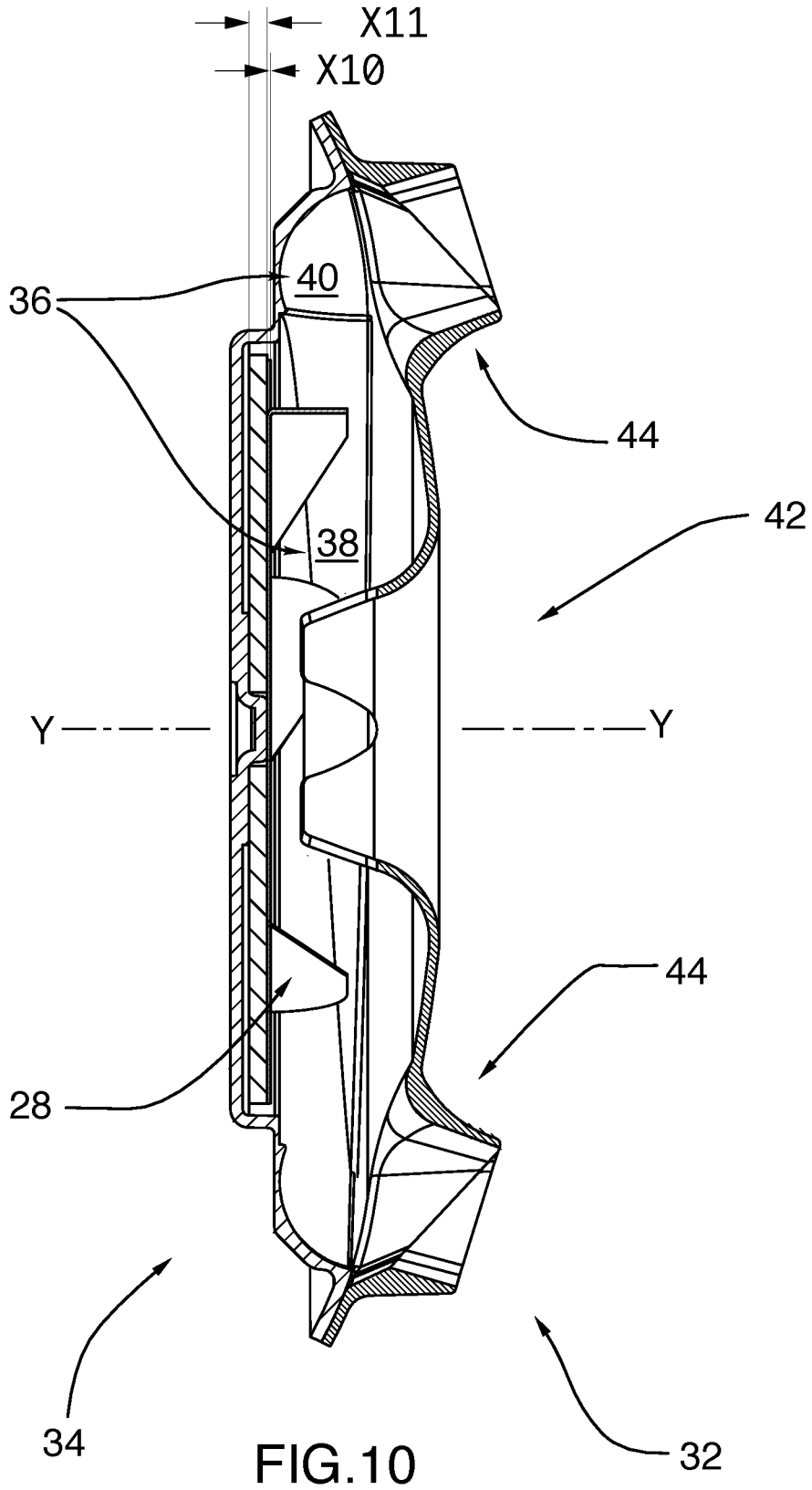
FIG. 10 is a view along section 10-10 of FIG. 9
Figure 11:
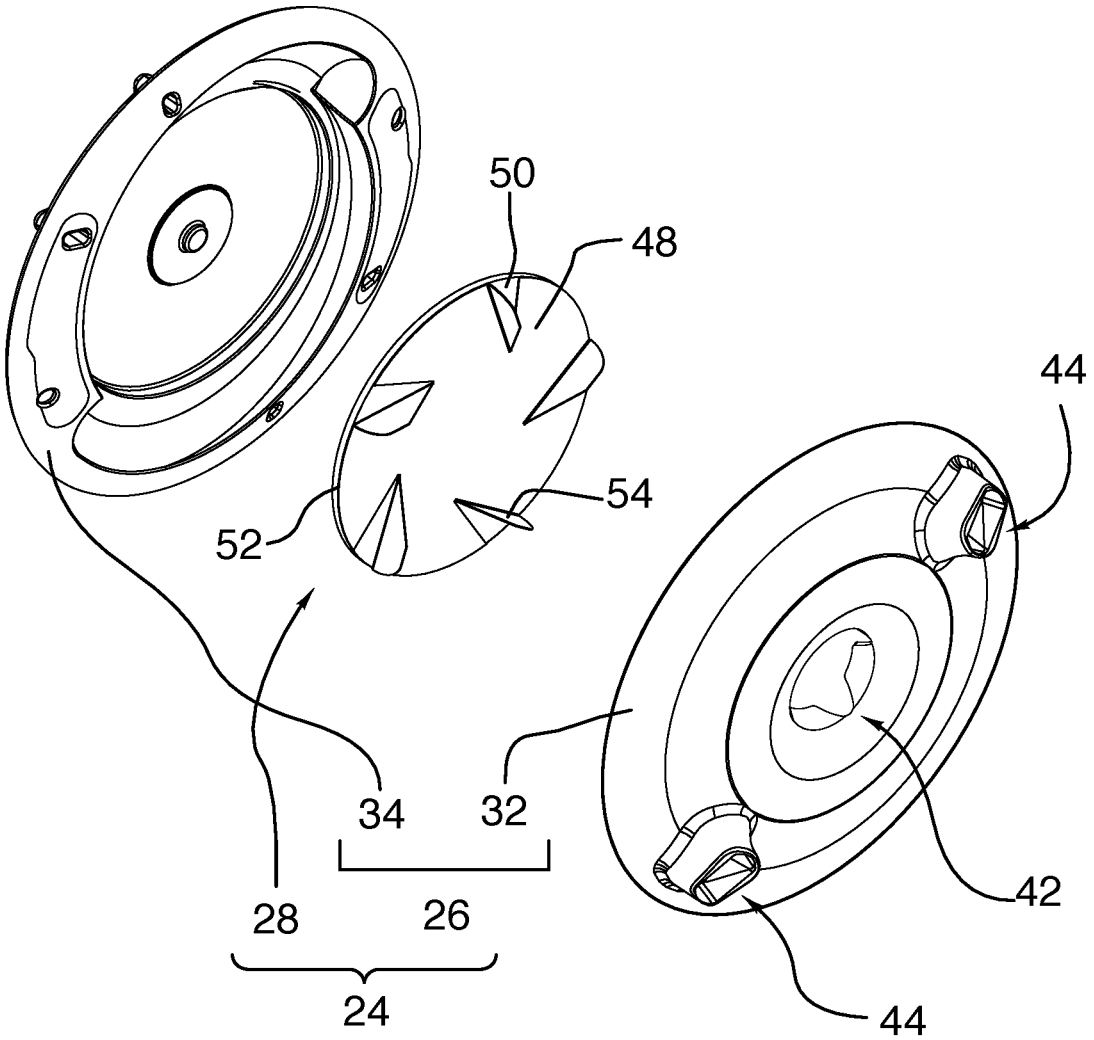
FIG. 11 is an exploded view of the structure of FIG. 7

The system 20 comprises an adapter 22 and a disposable pump 24, embodiments thereof being shown in FIG. 6.

The disposable pump 24 of FIG. 6 is shown in isolation in FIGS. 7-11 and will be seen to include a housing 26 and an impeller 28.

The housing 26 has a pair of sides 32,34 and defines a void 36 having a center 38 and a periphery 40, one 32 of the pair of sides defining an intake 42 and one or more ports 44, the intake 42 communicating with the center 38 of the void and the ports 44 communicating with the periphery 40.

The impeller 28 is disposed in the void, defines a rotation axis Y-Y and includes a portion 48 that is ferromagnetic and a portion 50 that is not ferromagnetic, the portions being axially displaced from the other and abutting one another at a junction 52 that is generally circular. The ferromagnetic portion 48 is a steel stamping and defines a plurality of broad flat blades 54.

It will be understood that the disposable pump shown in FIGS. 7-11 is substantially identical to that shown in U.S. Ser. No. 17/021,004.

The adapter is shown in isolation in FIG. 12 through FIG. 19 and comprises a housing 56 and a rotor 58.

The housing has a rotation axis XX-XX and a pair of walls 60, 62 and defines a recess 63 flanked by the walls. The walls are plastic and are spaced-apart from one another along the rotation axis XX-XX. One 60 of the walls has a thickness X4 of 1 mm and the other 62 of the walls has a thickness X5 of one 1 mm and defines a plurality of detents 64.

The rotor 58 is positioned in the recess and has a shaft 65, a pair of magnetic layers 66,68 and a ferromagnetic layer 70. The rotor 58 is disposed in spaced relation to the housing 56 such that the spaces between 68 one of the pair of magnetic layers and the housing is X7 [1.0 mm] and the space between the other 66 of the pair of magnetic layers and the housing is X6 [1.0 mm].

The shaft 65 is coincident with the rotation axis XX-XX.

The magnetic layers are disposed in parallel relation to one another and such that the rotation axis XX-XX passes centrally through each magnetic layer and in perpendicular relation thereto. Each of the magnetic layers has a plurality of magnetic portions 70,72 ringing the rotation axis XX-XX. The 68 one of the pair of magnetic layers has a thickness X1 of 3 mm and has more magnetic portions 72 than the other 66 of the pair of magnetic layers which has a thickness X2 of 3 mm. The magnetic portions 71,72 are N5 magnets. The magnetic portions of the one 68 of the pair of magnetic portions are disc-shaped segments 72; the magnetic portions of the other 66 of the pair are pie-shaped 71.

Figure 20:
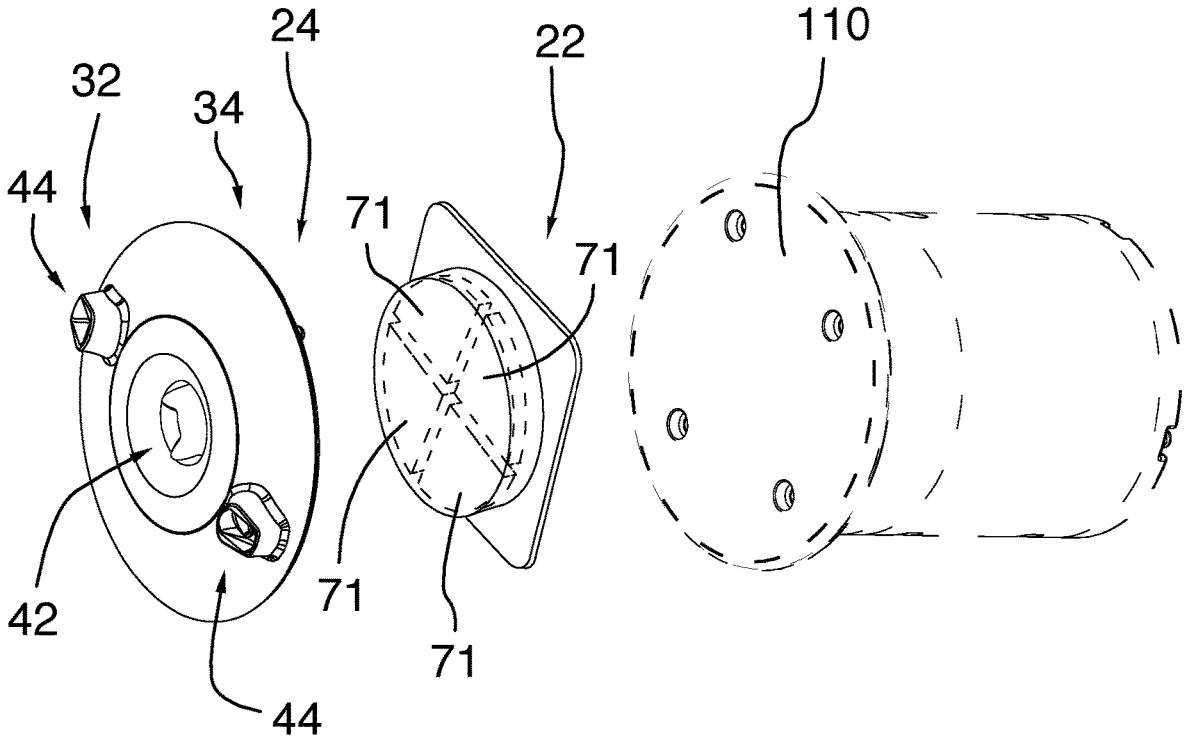
FIG. 20 is a view of the structure of FIG. 6. with a portion of the structure of FIG. 4.
Figure 21:
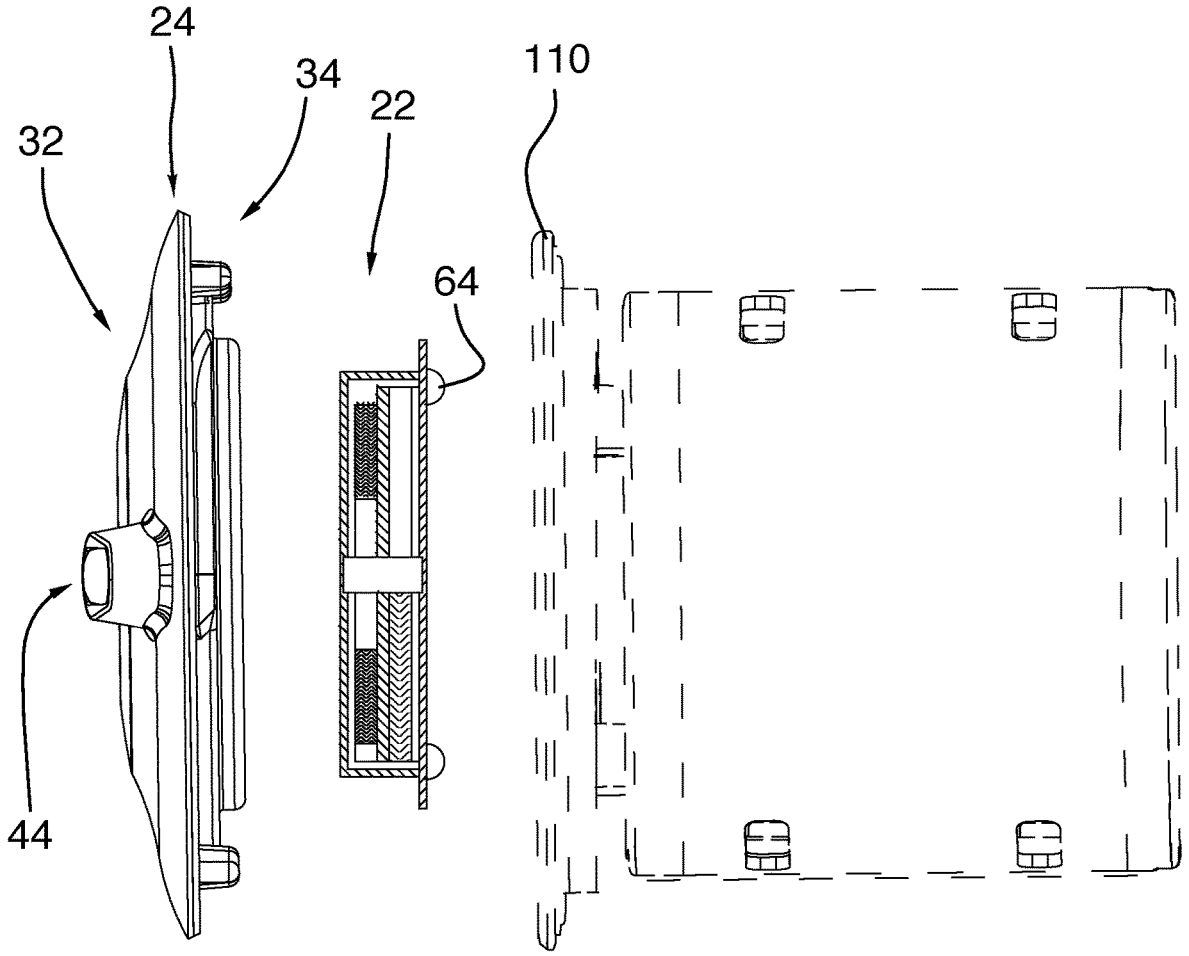
FIG. 21 is a view of the structure of FIG. 20 in partial section.
Figure 22:
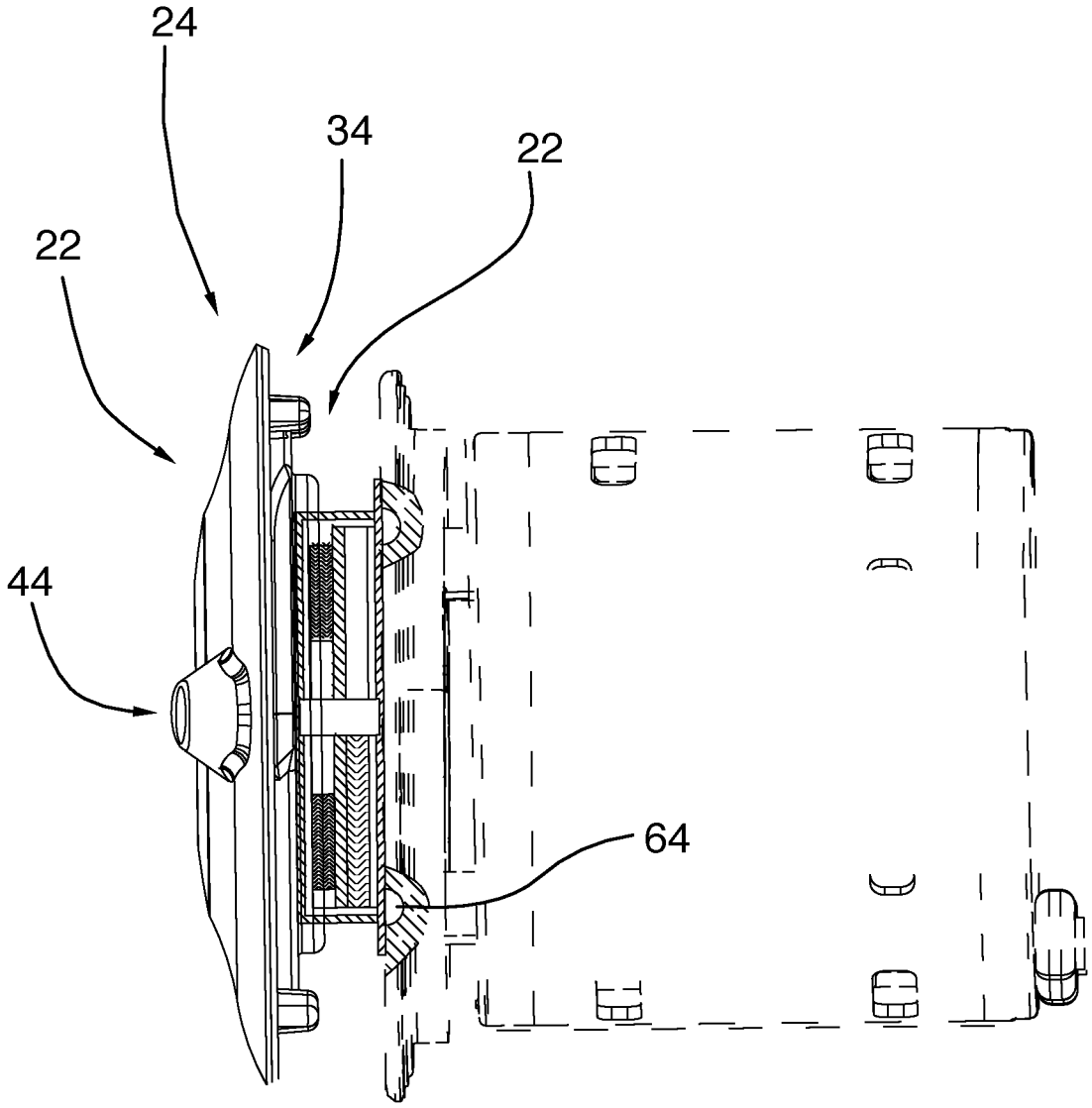
FIG. 22 is a view of the structure of FIG. 21 arranged for use.

The ferromagnetic layer 70 is iron, is disposed between the magnetic layers 66,68 and has a thickness X3 of 1.6 mm In use, the adapter 22 and the disposable pump 24 are disposed in the basin with the adapter 22 disposed between the basin 102 and the disposable pump 24 the detents 64 in the adapter engaging the sockets 112 in the cover plate 110.

as indicated by the sequence of FIGS. 20 and 21.

So positioned:

magnetic forces hold the adapter 22 in position against the basin 106 and hold the pump 24 in position against the adapter 22;

rotation of the drive hub 106 causes rotation of the rotor 58 the connection between detents 64 in adapter 22 and sockets 112 hold the adapter 24 against rotation rotation of the rotor 58 causes rotation of the impeller 28 rotation of the impeller 28 causes water to be drawn through the intake 42 and expelled through the ports 44, to circulate water in the basin.

Surprisingly, housing 26 does not rotate with impeller 28 in use, notwithstanding the lack of pin and socket or similar connections between housing 26 of pump 24 and housing 56 of adapter 24.

Persons of ordinary skill will readily appreciate that the invention permits disposable pumps, of the type disclosed in U.S. Ser. No. 17/021,004 to be used with prior art spas that lack the cover plate of U.S. Ser. No. 17/021,004. One type of prior art spa with which the invention can be used is that sold by Luraco Technologies Inc. under Model L0704C.

Persons of ordinary skill will also readily appreciate that whereas a specific embodiment of a pump and adapter are shown and described herein, variations in both are possible.

Figure 12:
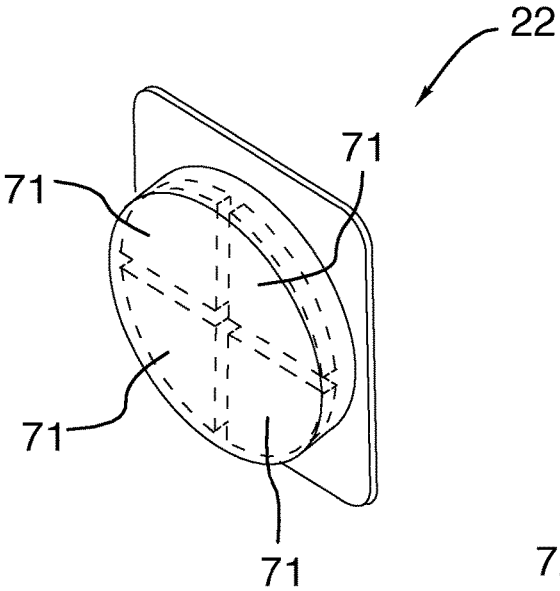
FIG. 12 is another view of the structure of encircled area 12 of FIG. 6, with some internal structures shown in phantom outline.
Figure 13:
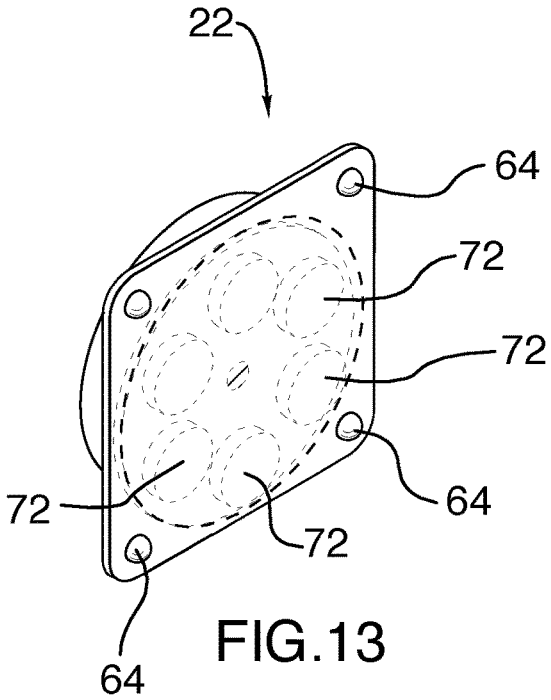
FIG. 13 is a rear perspective view of the structure of FIG. 12, with other internal components shown in phantom outline.
Figure 14:
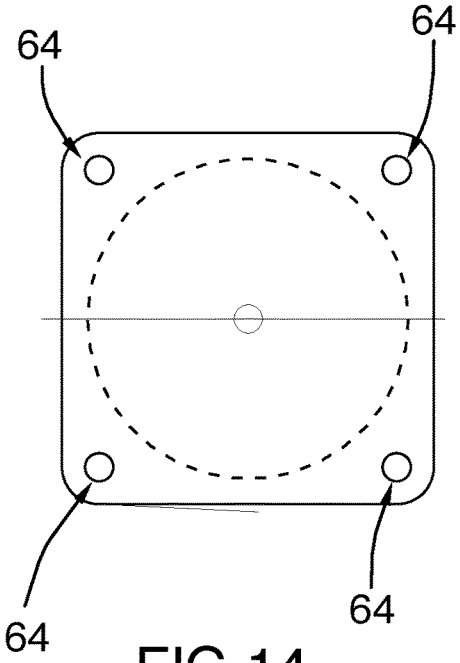
FIG. 14 is a rear plan view of the structure of FIG. 12, with some internal components shown in phantom outline.
Figure 15:
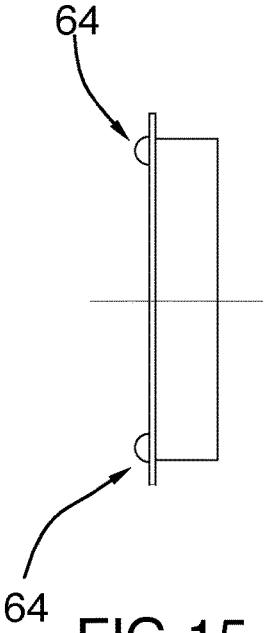
FIG. 15 is a side view of the structure of FIG. 12.
Figure 16:
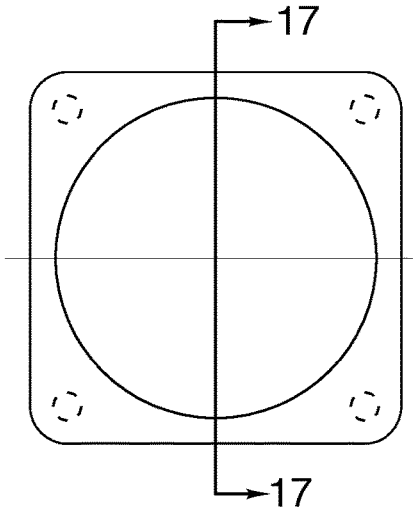
FIG. 16 is a front view of the structure of FIG. 12, with some features shown in phantom outline.
Figure 17:
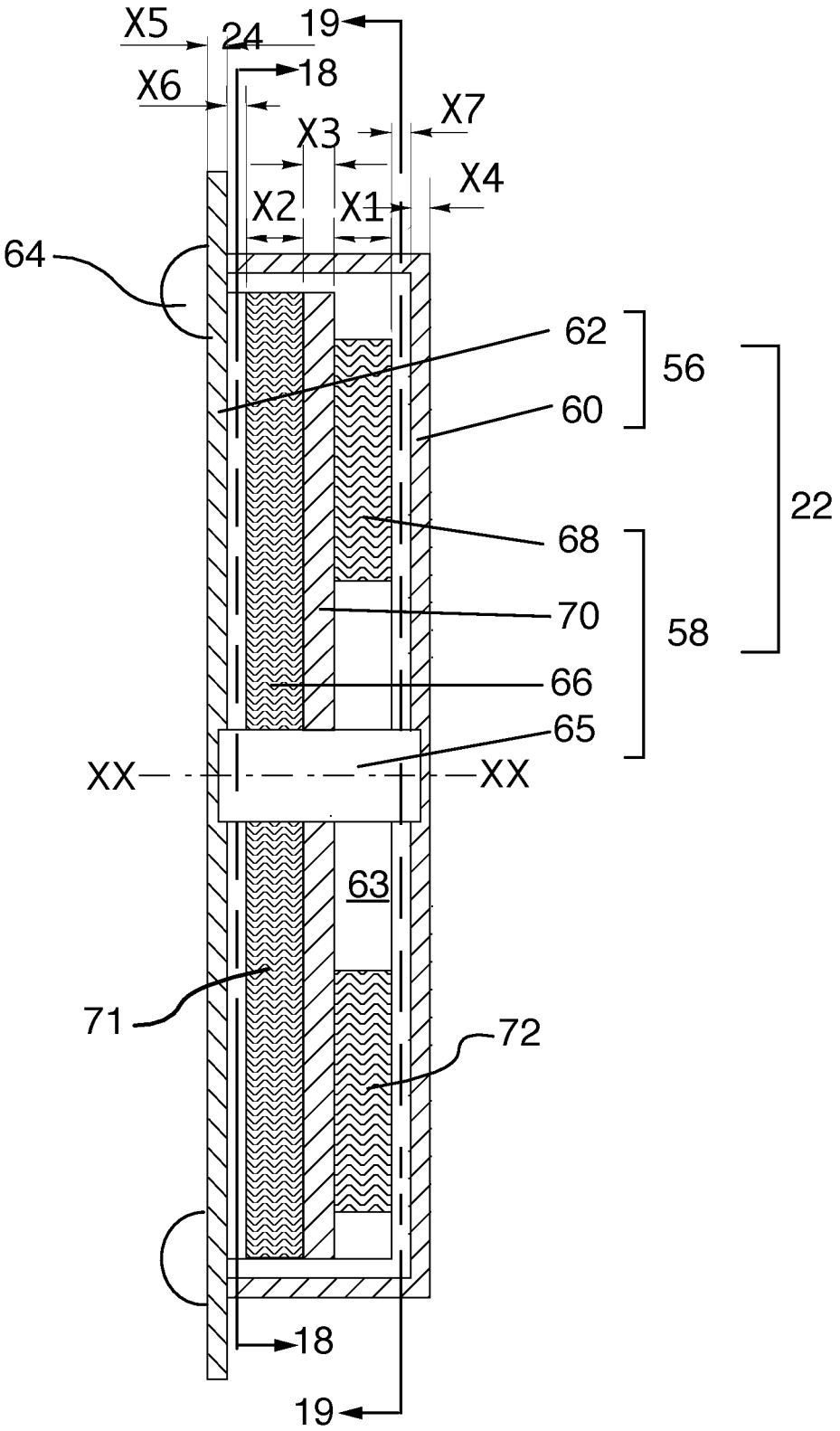
FIG. 17 is a view along section 17-17 of FIG. 16
Figure 18:
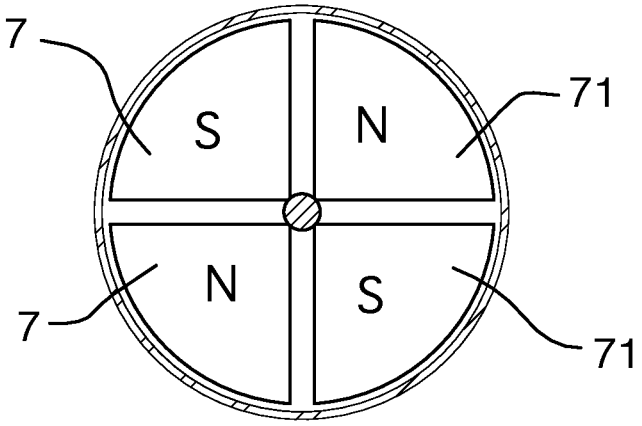
FIG. 18 is a view along section 18-18 of FIG. 17.
Figure 19:
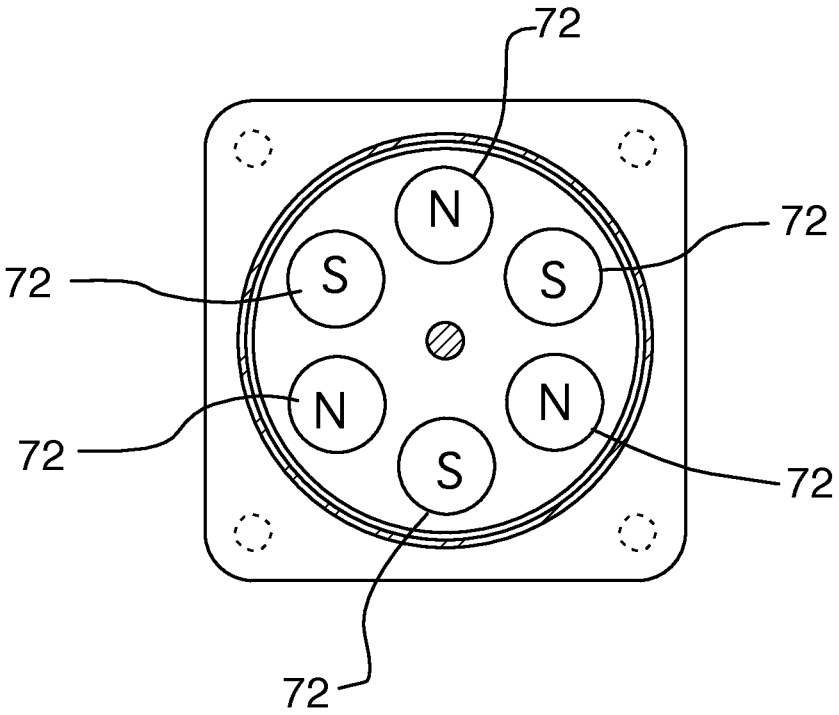
FIG. 19 is a view along section 19-19 of FIG. 17.

In this regard, FIGS. 23-31 show another embodiment of the structure of FIG. 12.

Figure 23:
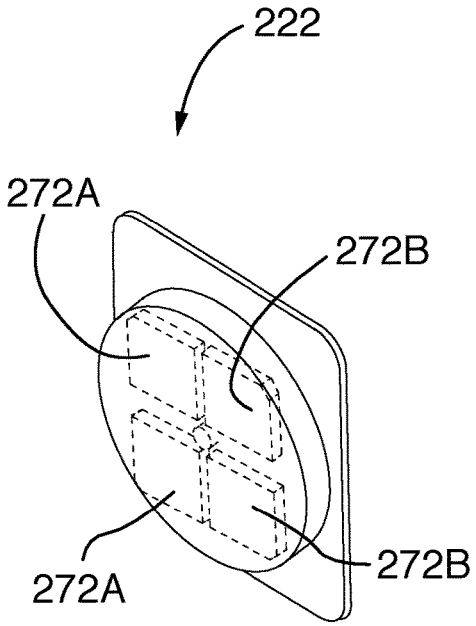
FIG. 23 is a view of an alternate embodiment of the structure of FIG. 12, with portions shown in phantom.
Figure 24:
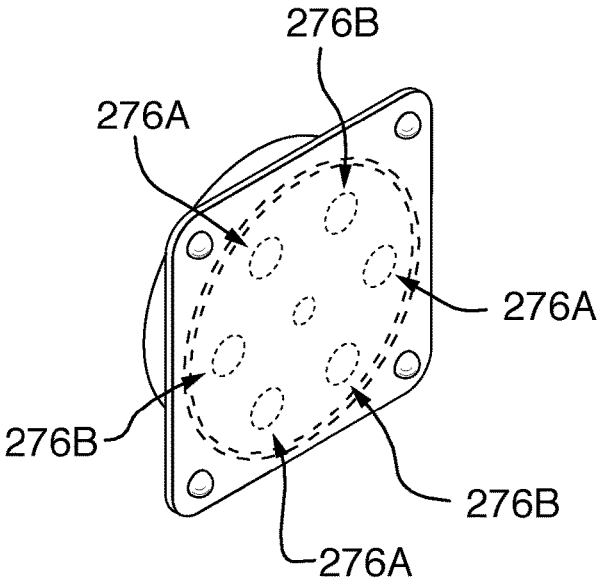
FIG. 24 is a view of the opposite side of the structure of FIG. 23, with portions shown in phantom.
Figure 25:
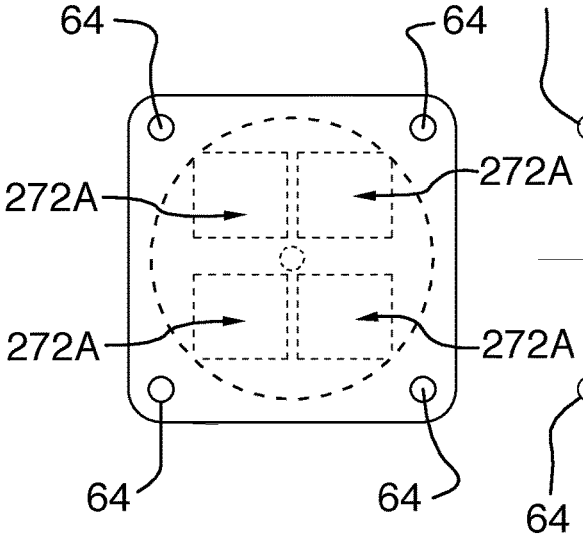
FIG. 25 is a plan view of the structure of FIG. 23.
Figure 26:
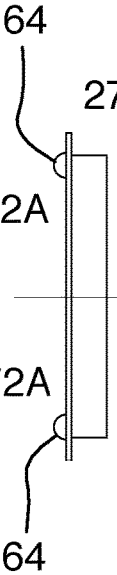
FIG. 26 is a side view of the structure of FIG. 23.
Figure 27:
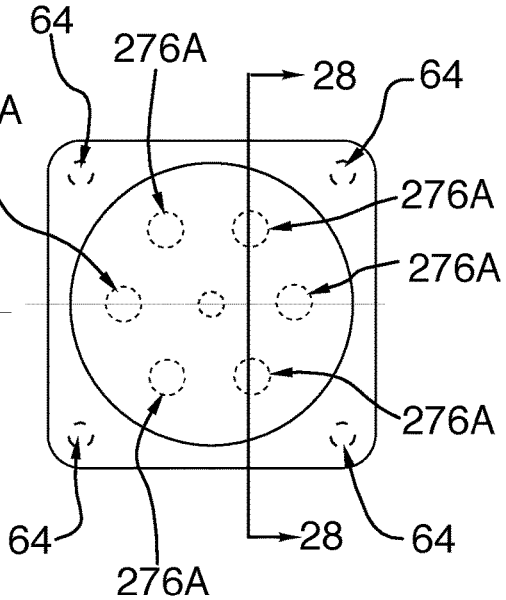
FIG. 27 is a plan view of the structure of FIG. 24.
Figure 28:
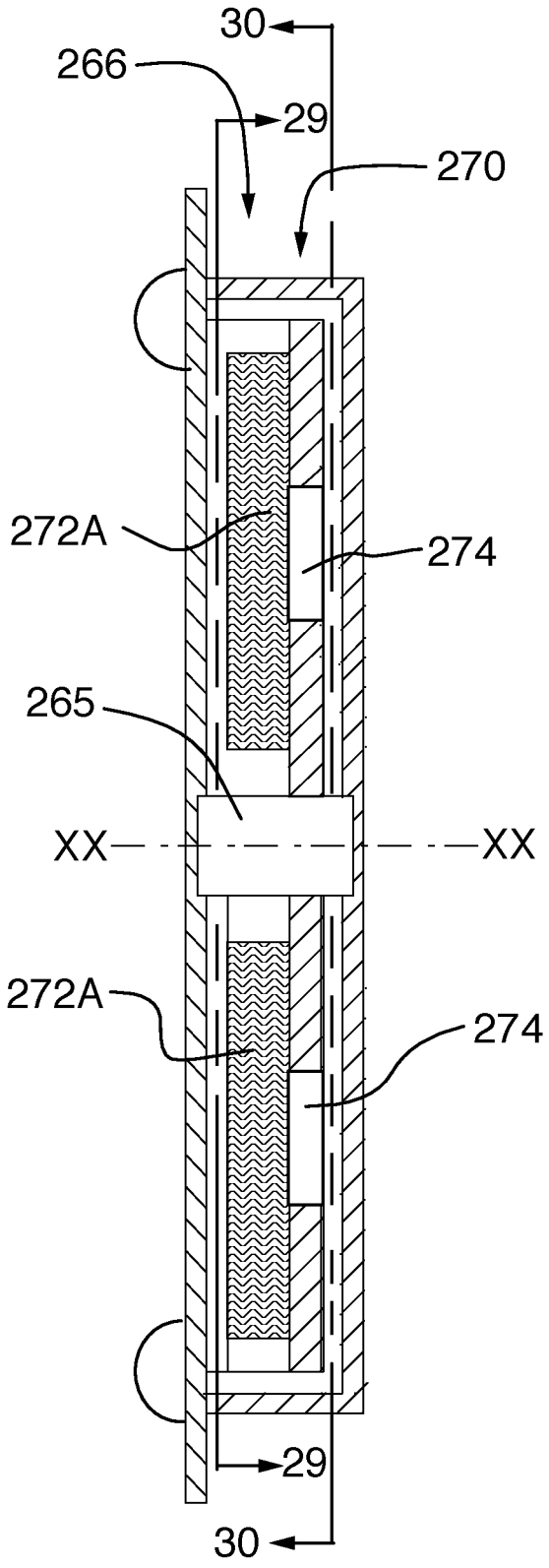
FIG. 28 is a view along section 28-28 of FIG. 27.
Figure 29:
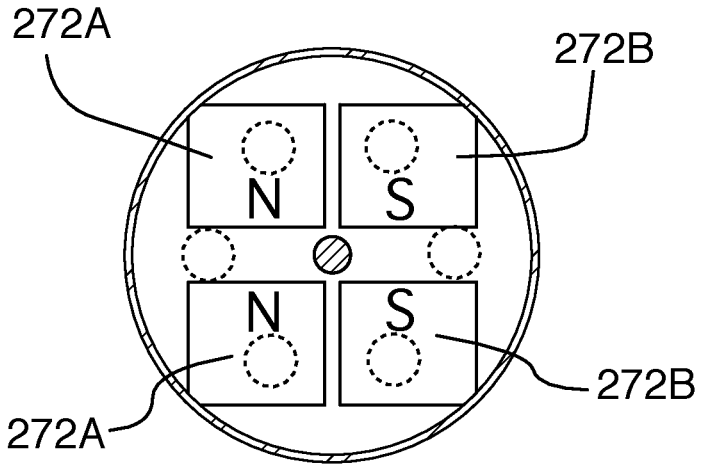
FIG. 29 is a view along section 29-29 of FIG. 28.
Figure 30:
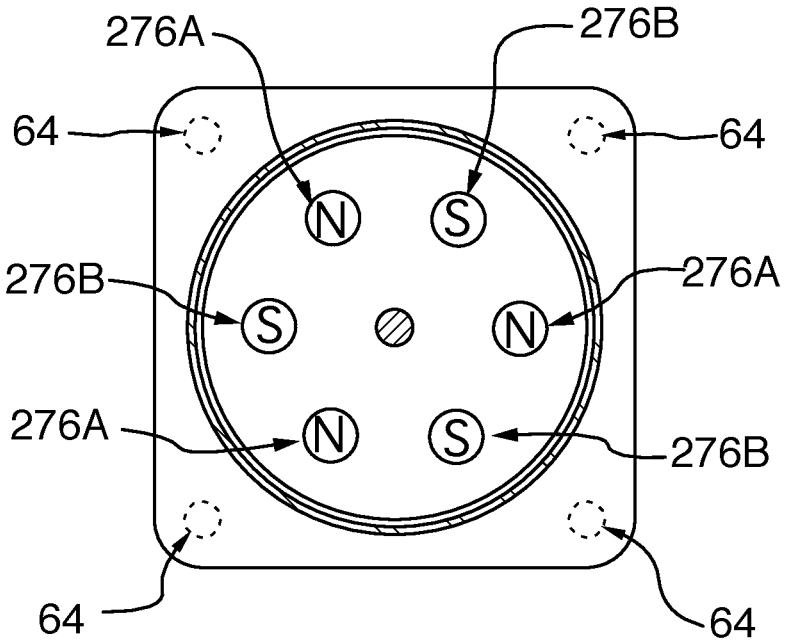
FIG. 30 is a view along section 30-30 of FIG. 28.
Figure 31:
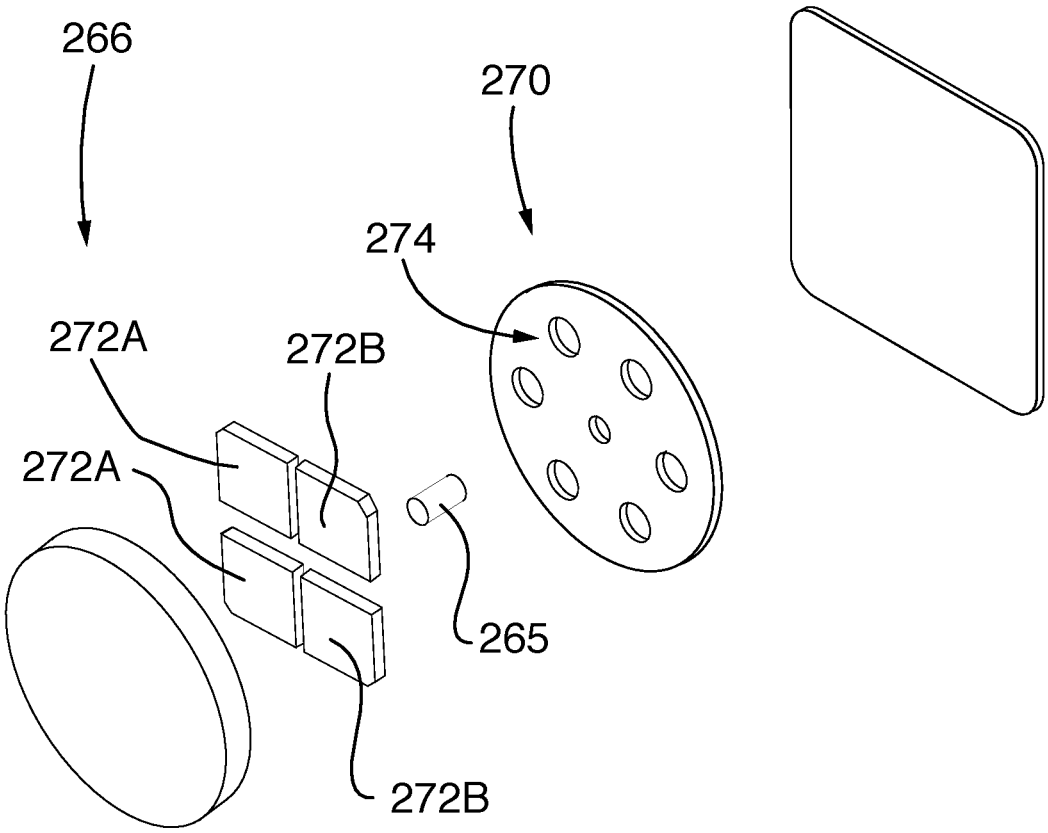
FIG. 31 is an exploded view of the structure of FIG. 23.

This embodiment functions in a manner substantially identical to the structure of FIG. 12 but whereas the structure of FIG. 12 has two layers of permanent magnets, separated by a ferromagnetic (iron) layer, one layer including four pie-shaped magnets arranged in alternating north-south relation about a rotation axis, the structure of FIG. 23 has:

a single layer 266 of permanent magnets 272A, 272B; and a perforated ferromagnetic layer 270.

The magnets of the single layer are similar to those of FIG. 12 in strength but are square and are disposed in opposed N-N and S-S pairs of aligned magnets 272A-272A and 272B-272B.

The perforations 270 of the ferromagnetic layer are disposed in spaced, circular relation about a shaft 265 and are arranged to focus the magnetic fields (produced by the magnets) that extend through the ferromagnetic layer 270 to define a plurality of poles, namely, six, 276A, 276B, arranged in alternating N-S relation and in radially spaced relation about the shaft 265.

Of course, yet further variations are possible. Accordingly, the invention should be understood to be limited only by the accompanying claims, purposively construed.

The invention claimed is:

1. A system comprising a disposable pump for use with a foot spa, the disposable pump comprising:

a housing having a pair of sides formed of a non-ferromagnetic material and defining a void having a center and a periphery, one of the pair of sides defining an intake and one or more ports, the intake communicating with the center of the void and the ports communicating with the periphery; and an impeller in the void wherein the impeller includes a portion that is ferromagnetic and a portion that is non-ferromagnetic, the portions being axially displaced from the other;

wherein the pump is configured to be disposed in a foot spa basin by a releasable magnetic engagement with an adapter such that upon rotation of a drive hub positioned outside of the foot spa basin and consequent rotation of a rotor positioned within the adapter, the impeller rotates to draw water through the intake and eject water through the one or more ports; and, wherein the rotor positioned within a housing of the adapter has a rotation axis and comprises:

a pair of magnetic layers disposed in parallel relation to one another and such that a rotation axis passes centrally through each magnetic layer and in perpendicular relation thereto; and a rotor ferromagnetic layer between the magnetic layers.

2. The system according to claim 1, wherein the impeller is adapted to draw water through the intake and eject water through the one or more ports as aforesaid by flat blades.

3. The system according to claim 1, wherein the ferromagnetic portion of the impeller abuts the non-ferromagnetic portion of the impeller at a junction that is circular.

4. The system according to claim 2, wherein the ferromagnetic portion of the impeller defines the flat blades.

5. The system according to claim 1, wherein the ferromagnetic portion of the impeller is steel.

6. The system according to claim 1, wherein the ferromagnetic portion of the impeller is a steel stamping.

7. The system according to claim 1, wherein the non-ferromagnetic portion of the impeller is aluminum.

8. The system according to claim 1, wherein the ferromagnetic portion of the impeller has a thickness X10, the non-ferromagnetic portion of the impeller has a thickness X11, X10 is between about 0.1 mm and 0.2 mm and X11 is between about 0.9 mm and 2.0 mm.

9. The system according to claim 8, wherein the thickness X10 is about 0.15 mm and the thickness X11 is about 2 mm.

10. The system according to claim 1, wherein each of the magnetic layers has a plurality of magnetic portions ringing the rotation axis.

11. The system according to claim 10, wherein a first magnetic layer of the pair of magnetic layers which, in use, is disposed adjacent the disposable pump, has the same number of magnetic portions as a second magnetic layer of the pair of magnetic layers.

12. The system according to claim 11, wherein:

the first magnetic layer of the pair of magnetic layers has a thickness X1;

the second magnetic layer of the pair of magnetic layers has a thickness X2;

the rotor ferromagnetic layer has a thickness X3;

the housing of the adapter has a pair of walls orientated perpendicular to the rotation axis, the walls having respective thicknesses X4 and X5; and the rotor is disposed in spaced relation to the housing of the adapter such that spaces between the magnetic layers and the housing are X6 and X7.

13. The system according to claim 12, wherein:

X1 is about 3 mm;

X2 is about 3 mm;

X3 is about 1.6 mm;

X4 is about 1 mm;

X5 is about 1 mm;

X6 is about 1 mm; and

X7 is about 1 mm.

14. The system according to claim 13, wherein the rotor ferromagnetic layer is iron and the walls are plastic.

* * * * *